US006302815B1

(12) United States Patent
Shishido et al.

(10) Patent No.: US 6,302,815 B1
(45) Date of Patent: Oct. 16, 2001

(54) BALL FOR A BALL GAME

(75) Inventors: Hideomi Shishido; Shigeo Doi; Yoshihisa Okimura, all of Hiroshima (JP)

(73) Assignees: Molten Corporation, Hiroshima (JP); Adidas International B.V., Amsterdam (NL)

( * ) Notice: Subject to any disclaimer, the term of this patent is extended or adjusted under 35 U.S.C. 154(b) by 0 days.

(21) Appl. No.: 09/297,932

(22) PCT Filed: Sep. 21, 1998

(86) PCT No.: PCT/JP98/04236

§ 371 Date: May 11, 1999

§ 102(e) Date: May 11, 1999

(87) PCT Pub. No.: WO99/15242

PCT Pub. Date: Apr. 1, 1999

(30) Foreign Application Priority Data

Sep. 22, 1997 (WO) ..... PCT/JP97/03350
Apr. 23, 1998 (JP) ..... 10-113848

(51) Int. Cl.[7] ..... A63B 41/00
(52) U.S. Cl. ..... 473/604; 473/598

(58) Field of Search ..... 473/598, 599, 473/603, 604, 605, 607, 608

(56) References Cited

U.S. PATENT DOCUMENTS 2,221,534 * 11/1940 Voit et al. .
5,865,697 * 2/1999 Molitor et al. .
5,888,157 * 3/1999 Guenther et al. .

FOREIGN PATENT DOCUMENTS 337647 8/1991 (JP) .
510833 3/1993 (JP) .
524353 6/1993 (JP) .

* cited by examiner

*Primary Examiner*—William M. Pierce
(74) *Attorney, Agent, or Firm*—Leydig, Voit & Mayer, Ltd.

(57) ABSTRACT

A ball for a ball game includes a bladder made of a spherical elastic air-impermeable material in a hollow spherical shape and filled with air; a spherical flexible shape-maintaining frame body containing the bladder and having openings; and skin panels in a surface skin layer and having edges contacting one another on the frame body, wherein at least the edges of the skin panels are adhered to the frame body.

21 Claims, 20 Drawing Sheets

BALL FOR A BALL GAME

TECHNICAL FIELD

The present invention relates to a ball for a ball game such as a soccer ball. More specifically, the present invention relates to a durable ball for a ball game having a high control property and which is not deformed, not varied in size, and not separated from a seam.

BACKGROUND ART

Conventionally, as a ball for a ball game of an air sealing structure such as a soccer ball, a volleyball and a handball, there are two kinds of balls, i.e., a laminated ball and hand stitched ball.

(1) As described in U.S. Pat. No. 4,333,648 for example, the laminated ball is made of air-impermeable rubber, and comprises a spheral hollow rubber bladder into which air is charged through a valve, a reinforcing layer Formed by winding a some thousands meter long nylon filament around the rubber bladder in its every circumferential direction, a cover rubber comprising a vulcanized rubber thin layer covered on the reinforcing layer, and a skin panel adhered to the cover rubber.

A quality of the ball (weight, size, sphericity, durability, upkeep property in shape, and increased strength with respect of passage of time) is stabilized by the reinforcing layer.

The cover rubber functions to allow the skin panel to strongly adhere to the carcass.

An artificial skin or a natural skin panel is used as a material of the skin panel.

With the above-described structure, the laminated ball can be mechanically manufactured and therefore, productivity is high (variation in weight and size is small), price is low, and sphericity and durability are excellent due to the winding reinforcing layer, but there is a drawback that the ball is hard and if the ball hits a human body, it painfully hurts him or her. Further, since the ball is hard, there are problems that it is difficult to control the ball, and it is difficult to make use of a high technique.

The reason why the ball is hard is that absorption of impact when the ball is kicked only depends on elasticity of the nylon constituting the reinforcing layer.

(2) As described in U.S. Pat. No. 4,462,590 for example, the hand stitched ball comprises a bladder of the above-described laminated ball, and a surface skin layer formed by inwardly folding edges of a plurality of skin panels and sewing these edges into a spherical shape by a thread (thread of about 10,000 denier).

The bladder is accommodated in the surface skin layer. An artificial skin or a natural skin panel is used as the skin panel. Three to four cloths are adhered to the back surface of the artificial skin (which is called as a backing material). Sewing operation is carried out manually.

The hand stitched ball constituted in the above-described manner is soft, the ball feels good and thus is easy to play with, and it is easy to control the ball. On the other hand, however, since the ball is cubic, it can not be sewed by a sewing-machine and thus, it must be sewed manually. Therefore, there are problems that the hand stitched ball requires a skill for manufacture, the difference in skill among individuals is large, the productivity is poor, the cost is expensive, a quality (weight, variation in size, sphericity, durability and the like) is unstable, level of defectiveness is two to three times greater than that of the laminated ball, durability is inferior, and the ball is prone to be deformed.

When a ball receives an internal pressure of about 1.0 $kg/cm^2$ and an impact by kicking or the like, an impact of some hundreds kg or more is applied to the ball. Therefore, there is an inconvenience that a seam of the ball may come apart, and a size of the ball may become larger than a standard or may be deformed. For this reason, there are problems that the thread may be cut due to the impact, a knot of the thread is untied and the bladder is exposed. Normally, durability of the hand stitched ball is one-half to one-third or less of that of the laminated ball.

A high control property of the hand stitched ball depends on the backing material (in the case of the skin panel, the backing material is included) of normally three to four layers backed on the back surface of the skin. The cloth has a corrugated structure in which the warp and the woof are crossed, and both the warp and the woof are woven from above and below with each other. The backing member has the same shape as that of the skin panel, and the backing member is independent for every skin panel. The cloth has a bias effect, and a function for absorbing the impact more effectively. The bias effect means an effect showing a large elasticity when the cloth is pulled in a direction inclined 45 degrees with respect to the warp and the woof. Therefore, the cloth has an excellent elasticity when it receives a shock.

Whereas, the nylon filament constituting the reinforcing layer of the laminated ball is not corrugated but is linear along the spherical surface, and is continuous. Therefore, impact absorbing performance is inferior.

From the above-described features, a highly skilled player uses the hand stitched ball in many cases, and the hand stitched ball is generally used for ball games. Whereas, the laminated ball is used in an elementary school or a junior high school, or is used for practice in many cases.

In order to improve the touch of the laminated ball, there has been proposed a structure in which a tape-like rubber is adhered only to a region of the winding reinforcing layer adjacent the skin panel, and only the edge portion of the skin panel is adhered to the rubber (Japanese Utility Model Registration No. 37647/1991). In this structure, however, the winding reinforcing layer exists, and the hardness due to this layer can not be moderated.

The present invention has been accomplished in view of such circumstances, and it is an object of the present invention to realize a ball having merits of these two kinds of balls, i.e., a ball having excellent productivity, durability, quality, and touch-feeling and which can easily be controlled.

DISCLOSURE OF THE INVENTION

A ball for a ball game according to the present invention comprises: a bladder made of an elastic material having air-impermeability and formed into a hollow spherical shape and into which compressed air is charged; a spherical frame body which accommodates the bladder and has a shape maintenance property and flexibility, and which forms a plurality of spaces; and a plurality of skin panels constituting a surface skin layer arranged such that ends of the skin panels are contacted to one another on the frame body, wherein at least the ends of the plurality of skin panels are adhered to the frame body.

The frame body preferably comprises a slender frame body constituting portion corresponding to a line on which the plurality of skin panels are contacted to one another, the frame body constituting portion is connected such that a closure domain is constituted, and at least the ends of the skin panels are adhered to the frame body constituting portion of the frame body.

It is preferable that the frame body constituting portion of the frame body is of a slender flat plate shape.

Further, it is preferable that the frame body constituting portion is partially cut and the frame body constituting portion is formed with a flap because a natural cubic shape can be obtained as a whole ball.

Further, it is preferable that the frame constituting portion comprises thermoplastic elastomer.

Further, it is preferable that the frame body constituting portion comprises a cloth of a single layer or a plurality of laminated layers.

Further, it is preferable that the frame body constituting portion comprises a plurality of cloths and a laminated rubber elastic material.

Further, it is preferable that the frame body constituting portion is formed such that ends of the plurality of slender cloths or ends of the laminated materials are arranged side-by-side, a backing cloth is backed to a back of the side-by-side arranged ends, and the ends are sewed together.

Further, it is preferable that the frame body constituting portion is formed such that ends of the plurality of slender cloths or ends of the laminated materials are superposed and the superposed ends are sewed together.

Further, it is preferable that the skin panel comprises a plurality of cloths are pasted to a back surface of the skin, and an end of the back surface of the skin panel is diagonally cut off.

Further, it is preferable that the skin panel comprises a plurality of cloths are pasted to a back surface of the skin, and side surfaces of ends of the cloths are covered with the skin panel.

Further, it is preferable that a reinforcing layer having a great tensile strength is interposed between the plurality of cloths.

Further, it is preferable that the reinforcing layer is made of any of polyester film, PVC film, polyethylene film and polypropylene film.

Further, it is preferable that the frame body constituting portion of the frame body includes a groove portion having a recess cross section which is recessed in the central direction of the ball, and an end edge of the skin panel is folded into the groove portion.

Further, it is preferable that the groove portion is provided at its opposite end edges with adhesion reinforcing portion which is extended in circumferential direction of the ball and to which the skin panels are adhered, the adhesion reinforcing portion is partially cut, and a flat is formed.

Further, it is preferable that the frame body constituting portion is made of thermoplastic elastomer.

Further, it is preferable that the frame body constituting portion comprises a cloth portion and a thermoplastic elastomer portion.

Further, it is preferable that a thick reinforcing portion is provided in place on a side surface of the groove portion.

The frame body has a structure in which an equilateral 32-surfaces cubic comprising twelve equilateral pentagons and twenty equilateral hexagons is curved outwardly into a spheral shape, the skin panel has a size and a shape substantially corresponding to each of the surfaces of the equilateral 32-surfaces cubic, and the ball can be used as a soccer ball or a handball.

The frame body includes a plurality of substantially rectangular spaces, a substantially rectangular skin panel is adhered to the frame body, and the ball can be used as a volleyball or a playground ball.

BEST MODE FOR CARRYING OUT THE INVENTION

Figure 1:
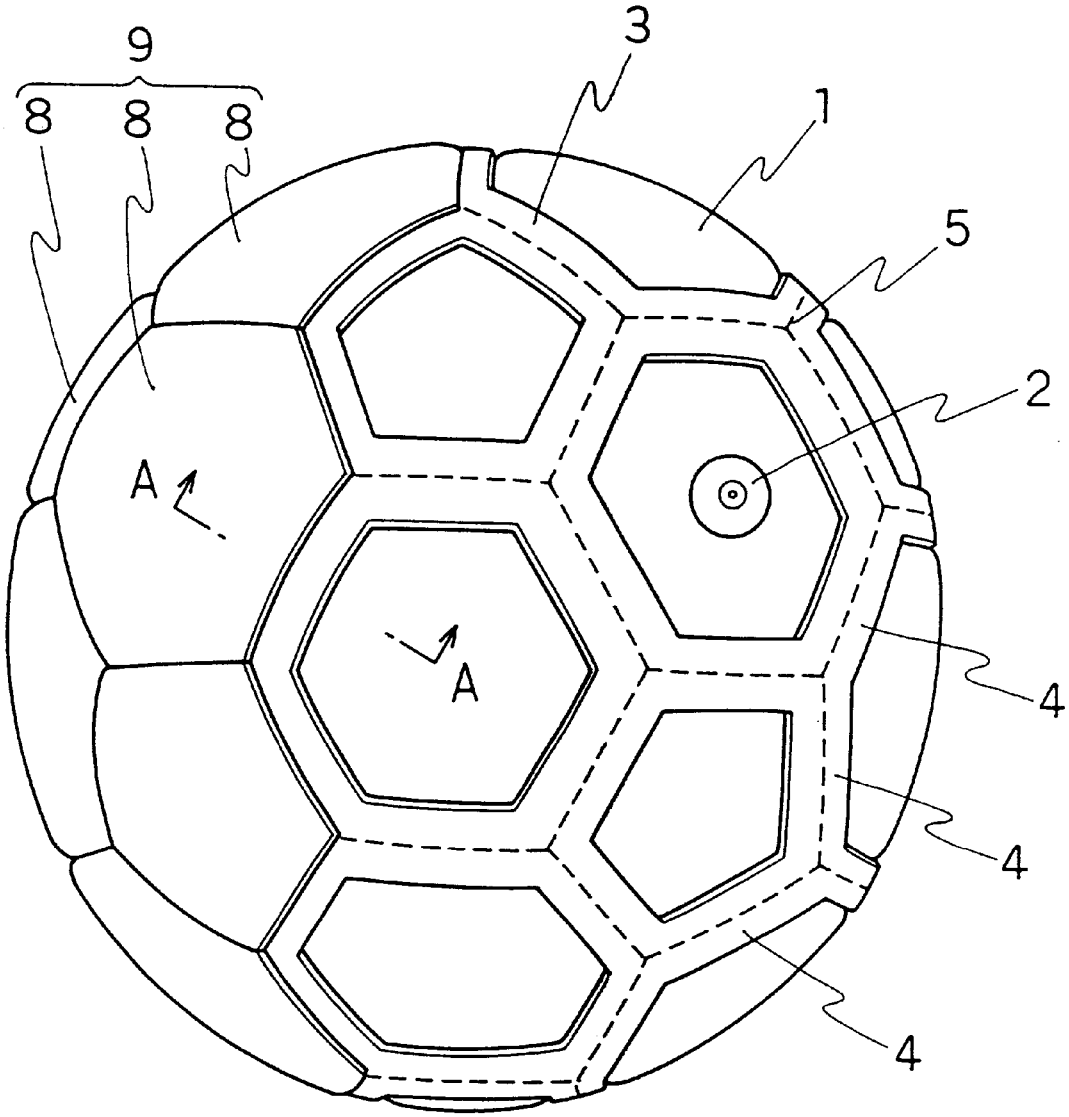
FIG. 1 is an explanatory view showing an example of a ball of an embodiment of the present invention.

FIG. 1 shows one example of a ball (soccer ball) according to one embodiment of the present invention, and shows, in a right two-thirds region in the drawing, a state in which a skin panel is removed. The reference number 1 denotes a bladder formed into a hollow spherical shape made of elastic material having an air-impermeability such as butyl rubber, latex rubber, polyurethane resin. The reference number 2 denotes a valve for charging compressed air into the bladder. An internal pressure of the ball in use is set to be about 1.0 kg/cm$^2$.

The reference number 3 denotes a frame body into which the bladder 1 is accommodated, and the frame body comprises an equilateral 32-surfaces cubic comprising twelve equilateral pentagons and twenty equilateral hexagons. Sides of these polygons are connected to one another at slender frame body constituting portions 4, and other portions are spaces. The reference number 5 denotes a center line drawn on the center of the frame body constituting portions 4. This center line is not necessarily required in the manufacturing process. The frame body constituting portions 4 are slightly curved outward so that the frame body constituting portions 4 are spherical as a whole. The frame body 3 functions to maintain the shape as a ball and therefore, the frame body 3 has flexibility and shape-maintenance property. Since the frame body 3 is pushed by the bladder 1, it is preferable that the frame body constituting portions form closure domains.

Figure 3:
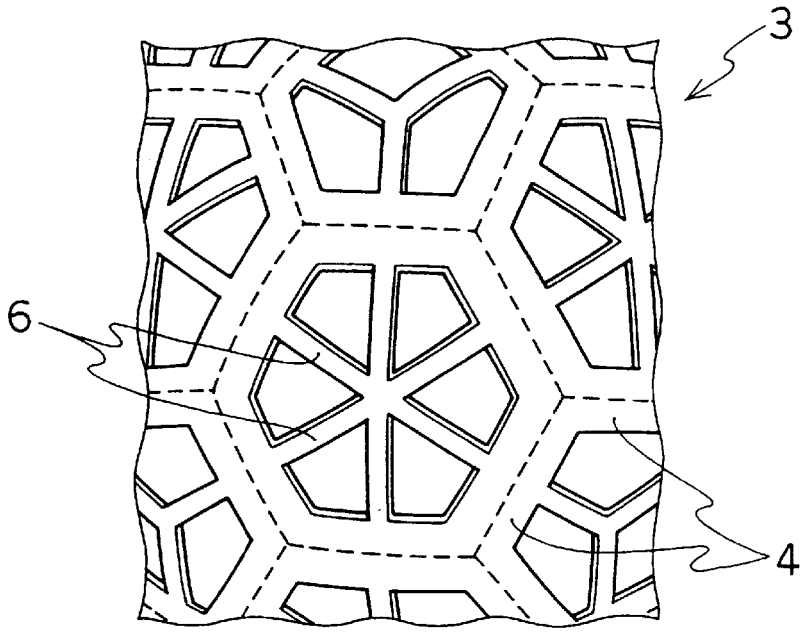
FIG. 3 is a schematic explanatory view showing another example of a frame body of the ball of FIG. 1.
Figure 4:
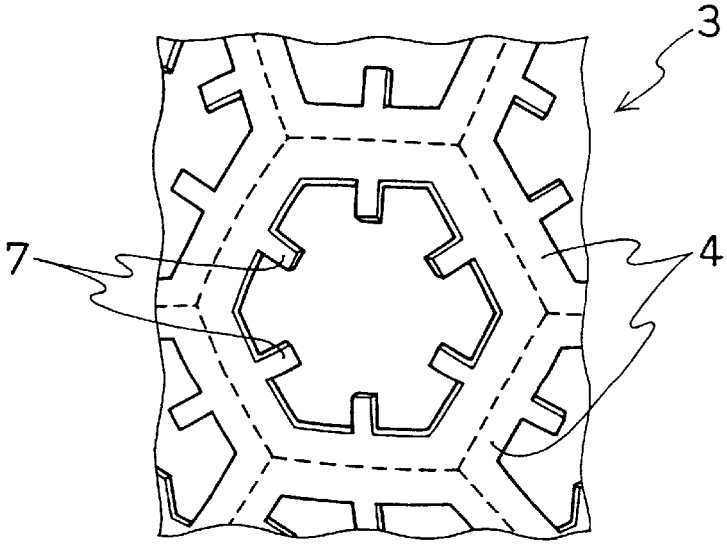
FIG. 4 is a schematic explanatory view showing still another example of a frame body of the ball of FIG. 1.

Alternatively, in order to reinforce the frame body 3, the frame constituting portions 4 may be formed with bridges 6 crossing the space of the pentagons or equilateral hexagons (see FIG. 3), or branch-like reinforcing members 7 may be projected from the frame constituting portions 4 (see FIG. 4).

A thermoplastic elastomer is suitable as a material of the frame body 3, and a single or a plurality of elastomers having appropriate grades are selected from the following elastomers, and are blended:

Thermoplastic polyurethane elastomer:

Paraprene (registered trademark, Nippon polyurethane Kogyo Kabushiki Kaisha), Takelax (registered trademark, Takeda Bardish urethane Kogyo Kabushiki Kaisha)

Thermoplastic elastomer polyester:

Pelprene (registered trademark, Toyo Bouseki Kabushiki Kaisha), Hytrel (registered trademark, TORAY Du Pont Kabushiki Kaisha)

Thermoplastic elastomer polyamide:

GRILUX A (registered trademark, Dai Nippon Ink Kagaku Kogyo Kabushiki Kaisha)

Thermoplastic elastomer polyolefin:

Sumitomo TPE (Sumitomo Kagaku Kogyo Kabushiki Kaisha), Milastomer (registered trademark, Mitsui Sekiyu Kagaku Kogyo Kabushiki Kaisha)

Thermoplastic elastomer polyethylen:

TUFTEC (registered trademark, Asahi Kasei Kogyo Kabushiki Kaisha), Kraton (registered trademark, Shell Kagaku Kogyo Kabushiki Kaisha)

Thermoplastic elastomer polyvinyl chloride:

Sumiflex (registered trademark, Sumitomo Bakelite Kabushiki Kaisha), Sunplane (registered trademark, Mitsubishi Monsanto Kasei Kabushiki Kaisha)

Thermoplastic elastomer polybutadiene:

JSR RB (Nippon Gousei Rubber Kabushiki Kaisha)

Since the frame body 3 needs to have flexibility and shape maintenance property, it is preferable that modulus at 50% is in a range of 30 to 200 kg/cm$^2$, and D-hardness is set in a range of 30 to 75 degrees. If modulus at 50 is smaller than 30 kg/cm$^2$, there is caused a phenomenon that the ball grows (expands) with passage of time, and if the D-hardness is smaller than 30 degrees, the same phenomenon is generated. If modulus at 50% is higher than 200 kg/cm$^2$, the ball is hardened, and the touch feeling is deteriorated. If D-hardness is higher than 75 degrees, the same problem is generated.

The frame body 3 can be formed by injection molding. That is, two halves of the frame body 3 is molded and then, they are melted with each other and bonded to each other by a thermal fusion bond, an ultrasonic fusion bond, a high-frequency fusion bond or a polyurethane-based adhesive, and the two halves are formed into a spherical shape. The frame body 3 can be formed by a vacuum forming process or rotation forming process, in addition to the injection molding. If the rotation forming process is used, a spherical integrally formed ball can be obtained.

The bladder 1 is accommodated in the space of the spherically formed frame body 3.

Figure 2:
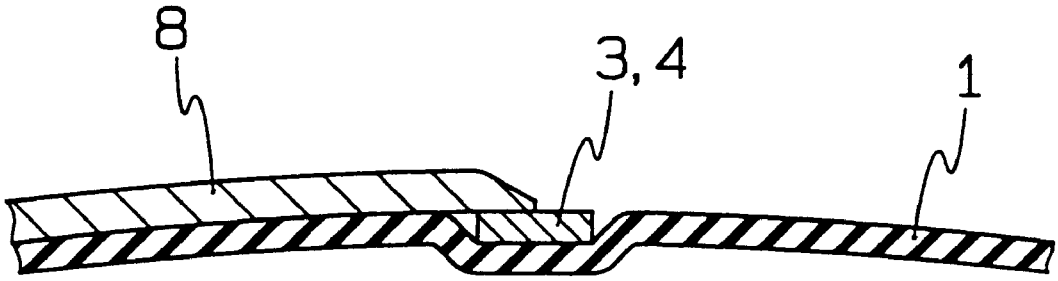
FIG. 2 is a sectional view taken along lines A—A of the ball of FIG. 1.

The frame constituting portion 4 can be formed into a flat plate shape as shown in FIG. 2, and its wide can be about 8 to 30 mm, and its thickness can be about 1.5 to 3.5 mm.

The reference number 8 denotes a plurality of skin panels arranged on the frame body 3 such that ends of the skin panels are contacted with one another, and the skin panels 8 constitute a surface skin layer 9. Corresponding to polygons of the frame body 3, the skin panels 8 comprises twelve equilateral pentagons and twenty equilateral hexagons. An artificial skin or pvc leather, or a natural skin panel is used as a material of the skin panel 8.

Figure 5:
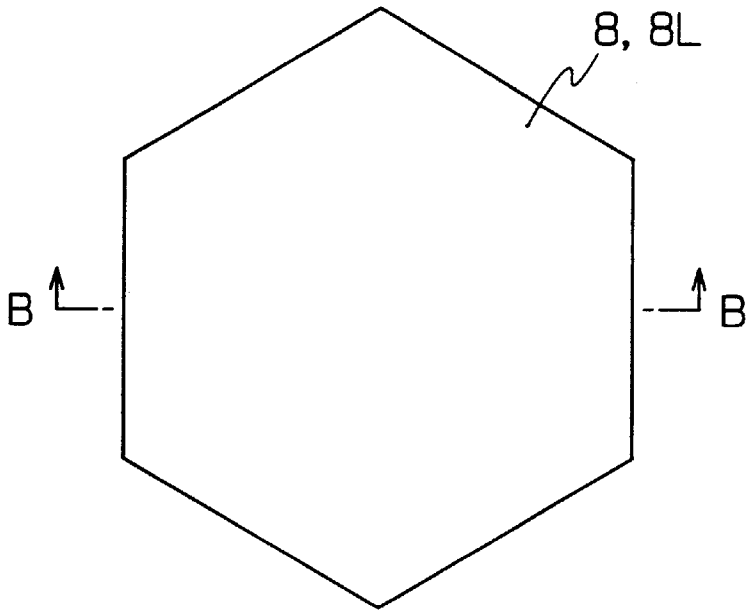
FIG. 5 is an explanatory view showing an example of construction of a skin panel used in the ball of FIG. 1.
Figure 6:
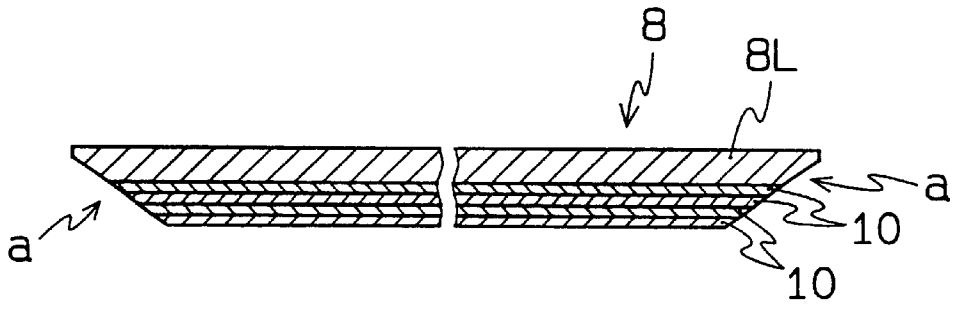
FIG. 6 is a sectional view taken along lines A—A of the skin panel of FIG. 5.

As shown in FIGS. 5 and 6, each of the skin panels 8 comprises a single or a plurality of (normally, three or four) cottons, mixed fabrics of cotton and polyester or cloth 10 comprising polyester only is pasted on a back surface of a skin 8L by latex. In order to obtain more soft touch feeling, it is possible to interpose a form such as polyurethane between the cloths 10.

A back surface of an end of the skin panel 8 is cut diagonally (shown by "a" in FIG. 6). This end of the skin panel 8 is adhered to the frame constituting portion 4 of the frame body 3 by the polyurethane-based adhesive and the like such that the end of the skin panel 8 is contacted with an end of the adjacent skin panel 8 at the center line 5. A groove of tortoiseshell which is peculiar to the soccer ball is formed at the adjacent two diagonally cut ends.

Figure 7:
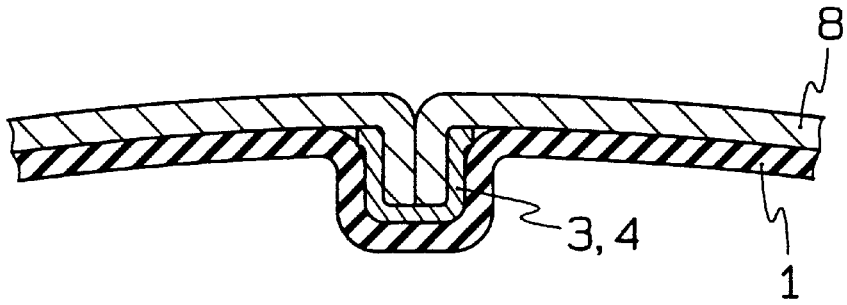
FIG. 7 is an explanatory view showing an example of the frame body of the ball of another embodiment of the present invention.
Figure 8:
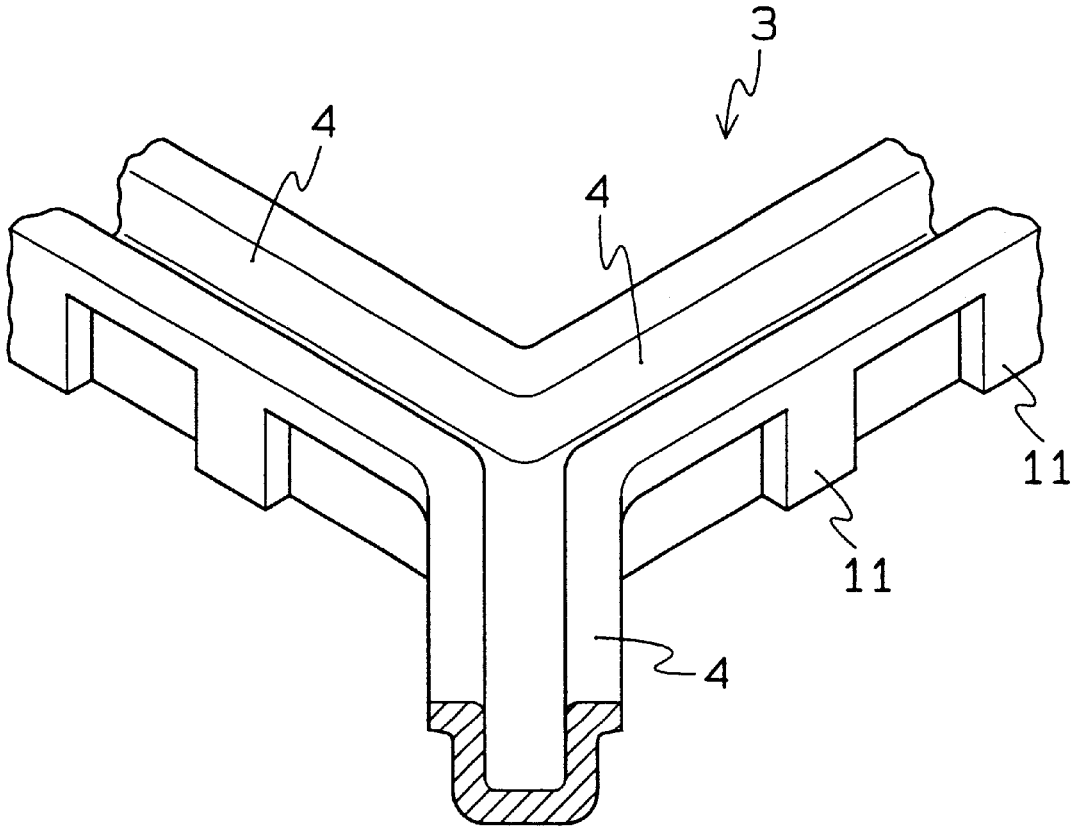
FIG. 8 is an explanatory view showing an example of the frame body of the ball of still another embodiment of the present invention.

FIGS. 7 and 8 show another example of the frame body 3 in which the frame constituting portion 4 is formed into a groove shape having recess-shaped cross section which is recessed in the central direction of the ball. The ends of the skin panels 8 are inwardly folded, and the ends of adjacent skin panels are pushed into the groove and adhered to the frame constituting portion. In this case, it is unnecessary to diagonally cut the ends. The frame constituting portion 4 can be formed with at its side surface with thick portions 11 as reinforcing members at a predetermined distance from one another. These thick portions 11 function to prevent the grooves from spreading outward in a fan-shape.

With the above-described structure, the ends of the skin panels 8 constitute deep grooves having the same outward appearance as that of the hand stitched ball. With this structure, there are obtained effects that aerodynamic characteristic is enhanced, a carry of the ball is increased. One example of size of the groove-shaped frame body is that a depth of the groove can be set in a range of about 3.0 to 15.0 mm, a width in a range of about 1.0 to 4.0 mm, and thickness in a range of about 2.0 to 4.0 mm.

With the above structure, the skin panel 8 is fixed only at its end by the frame body 3, and an essential portion of the skin panel 8 is contacted with the bladder 1. Such an essential portion is the same as that of the hand stitched ball. The end of the skin panel 8 is adhered to the frame body 3, and this feature is basically the same as the structure of the laminated ball.

The following Table 1 shows results of the impact values of various balls. The impact value is a value obtained by a force sensor detecting an impact force of a ball naturally dropped from one meter height. The soccer ball used in the embodiment has a frame body made of thermoplastic elastomer polyester Pelplene (registered trademark) having modulus 100 at 50% and D-hardness of 50 degrees, and the frame constituting portion has a flat plate-shaped cross section. The total weight (430 g of manually sewed ball) was taken as a standard or reference weight, and a weight difference was added to other balls so that influence due to the weight difference was eliminated.

TABLE 1

| | The ball of embodiments of the present invention | The conventional ball (hand stitched ball) | The conventional ball (laminated ball) |
|---|---|---|---|
| Total weight | 421 g | 430 g | 417 g |
| Impact value | 58.2 kg | 62.9 kg | 74.5 kg |

From the above result, it was confirmed that the ball according to the present embodiment has an impact value smaller by about 16 kg in comparison with the laminated ball, and this difference is a value sensible when the ball hits a human body and thus, the ball became soft to the touch.

Figure 9:
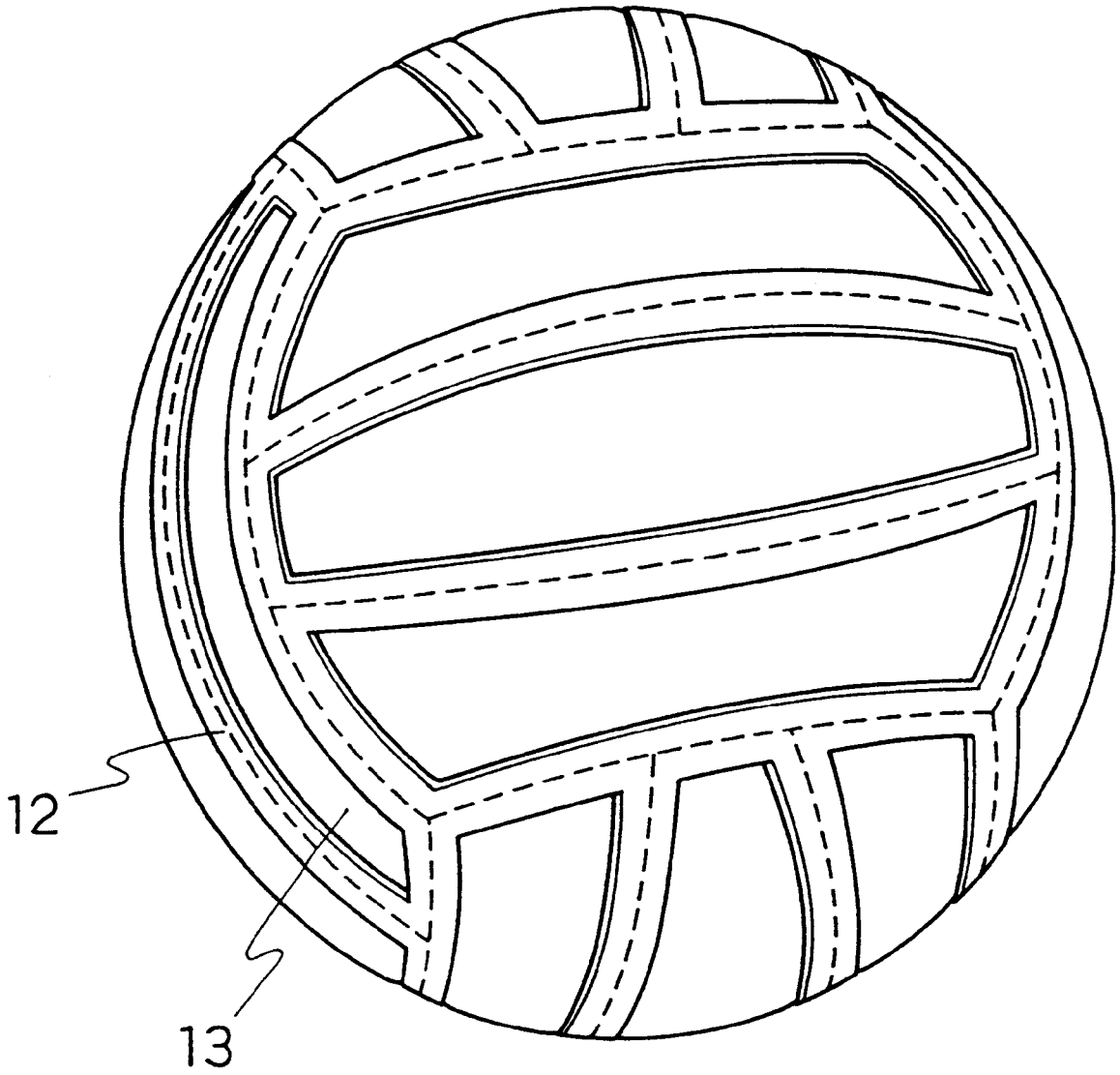
FIG. 9 is an explanatory view showing an example of yet another embodiment of the present invention.

FIG. 9 shows an example of a volleyball (the skin panel is removed). A frame body 12 is of a shape having eighteen rectangular spaces, and ends of skin panels are adhered on the spaces. In the case of the volleyball, the ball can include eighteen or twelve rectangular spaces. The skin panel does not necessarily coincide with a shape of the rectangular space, and two rectangular space may be covered with one skin panel. It is also possible to form the frame body 12 into a pattern of the line of a basketball so that the frame body 12 can be applied to the basketball structure, and also can be applied to a rugby ball.

Figure 10:
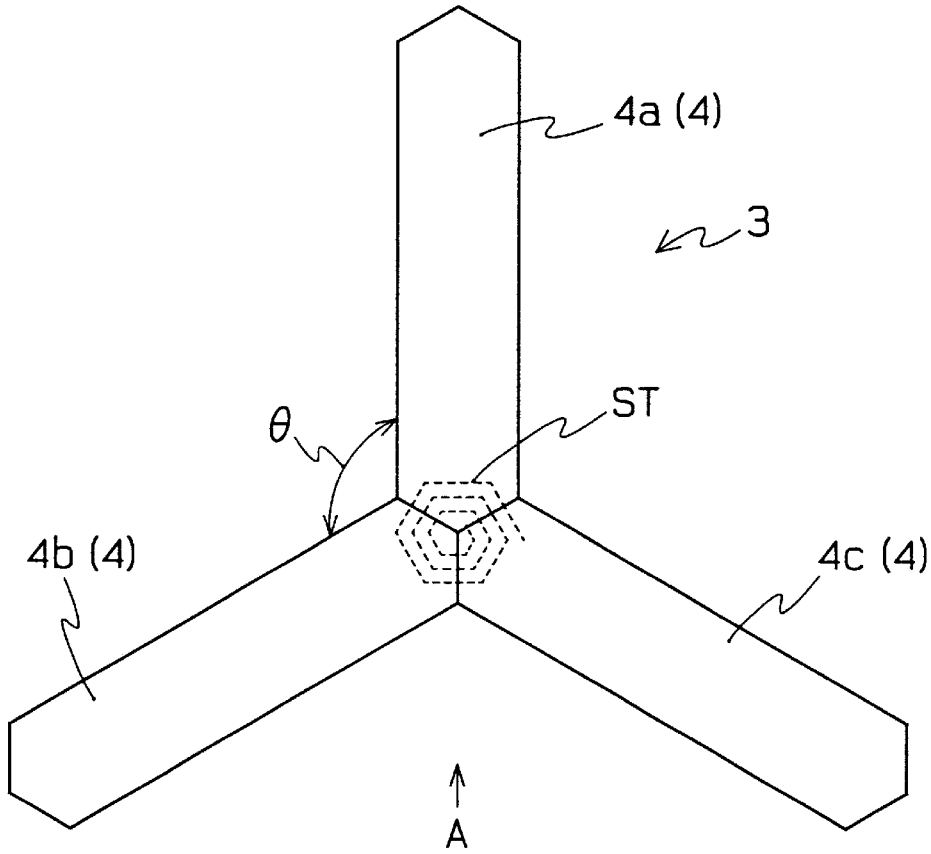
FIG. 10 is a schematic explanatory view showing an example of the frame body used in the ball of the present invention.
Figure 11:
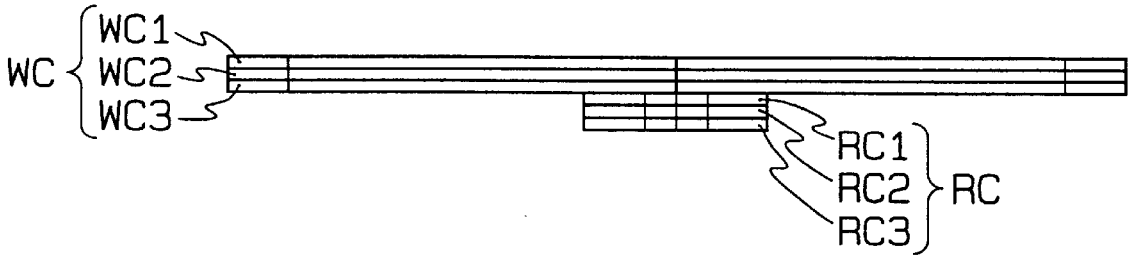
FIG. 11 is a side view of the frame body of FIG. 10 seen from the direction of arrow.
Figure 12:
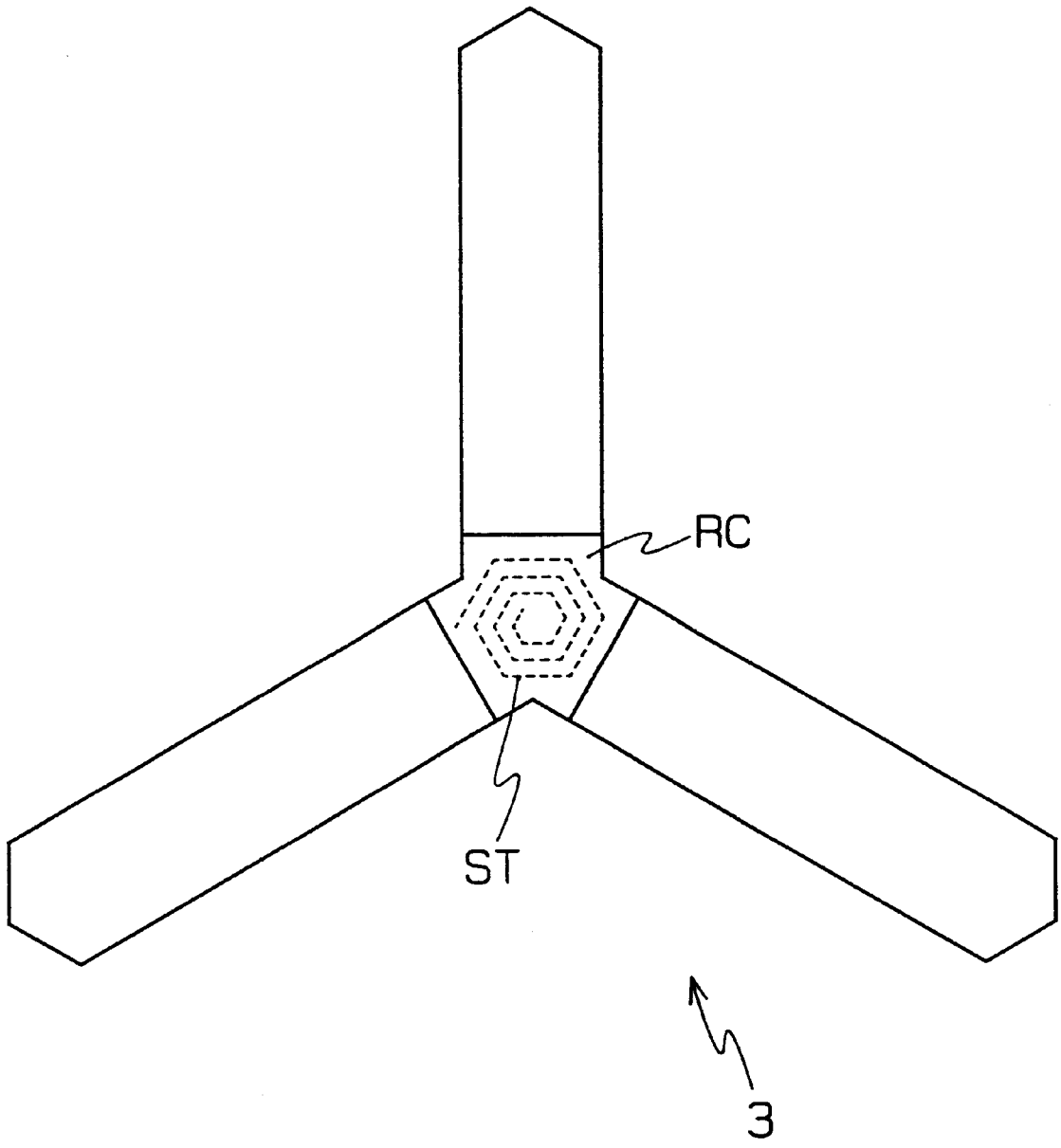
FIG. 12 is a schematic explanatory view showing another example of the ball of the present invention.

FIGS. 10 to 12 show each example in which a single of a plurality of laminated cloths WC is used as the frame body 3 of the ball for a ball game according to the present embodiment. In the illustrated example, three cloths WC1, WC2 and WC3 are superposed. The cloth WC1 may be replaced by a rubber elastic material, and natural rubber, SBR, CR, or EPDM may be used as this rubber. Opposite ends of the frame constituting portions 4 are cut into slightly sharpened shaped portions 4*a*, 4*b* and 4*c* (the angle θ is 120 degrees, for example), these three the ends are met together, and these sides are abutted against each other. A backing cloth RC of three layers structure comprising RC1, RC2 and RC3 is attached to the back side, and is sewed by a sewing thread ST.

Cottons, mixed fabrics of cotton and polyester or polyester can be used as the cloth of the frame constituting portion 4, and they are pasted by an adhesive such as CR latex or natural latex and then, are cut into a slender shape.

As the cloth, alamid fiber such as Kevlar (registered trademark) and Techmiran (registered trademark), or a high-strength cloth using carbon fiber may be used. By using such a high-strength cloth, it is possible to suppress the growth (expansion) of the ball, and since the strength is high, the amount of usage can be reduced and thus, the weight can be reduced also.

As the backing cloth RC, the above-described laminated cloths, i.e., about one to fourth cloths adhered by CR latex adhesive or the like can be used.

Figure 13:
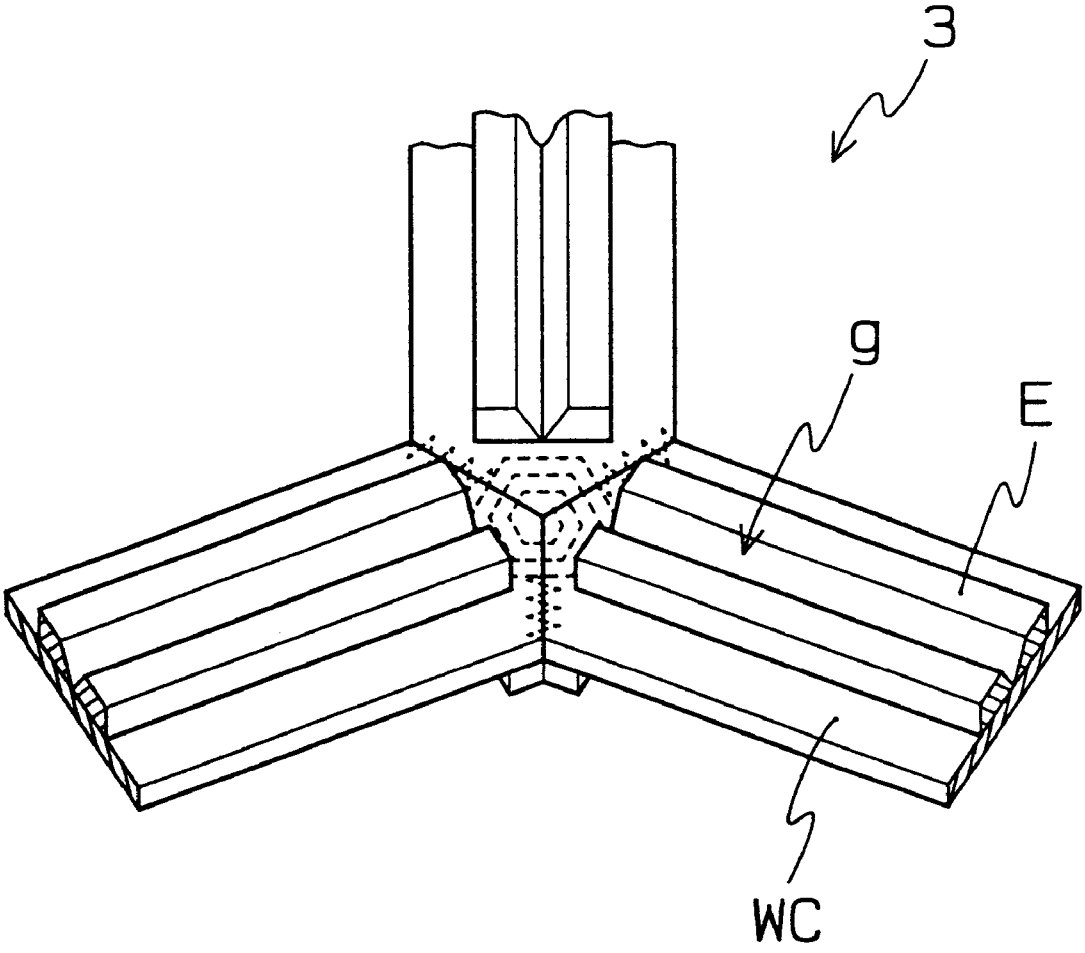
FIG. 13 is a schematic explanatory view showing another example of the ball of the present invention.

Referring to FIG. 13, the frame constituting portion 4 comprises laminated cloths WC, and a rubber or elastomer portion E having a groove g adhered on the laminated cloths WC. As the rubber material, natural rubber, SBR, CR or EPDM may be used, and as the elastomer, the above-described materials may be used. The rubber and the cloths WC are adhered to each other by vulcanized adhesive at the time of rubber molding.

Figure 14:
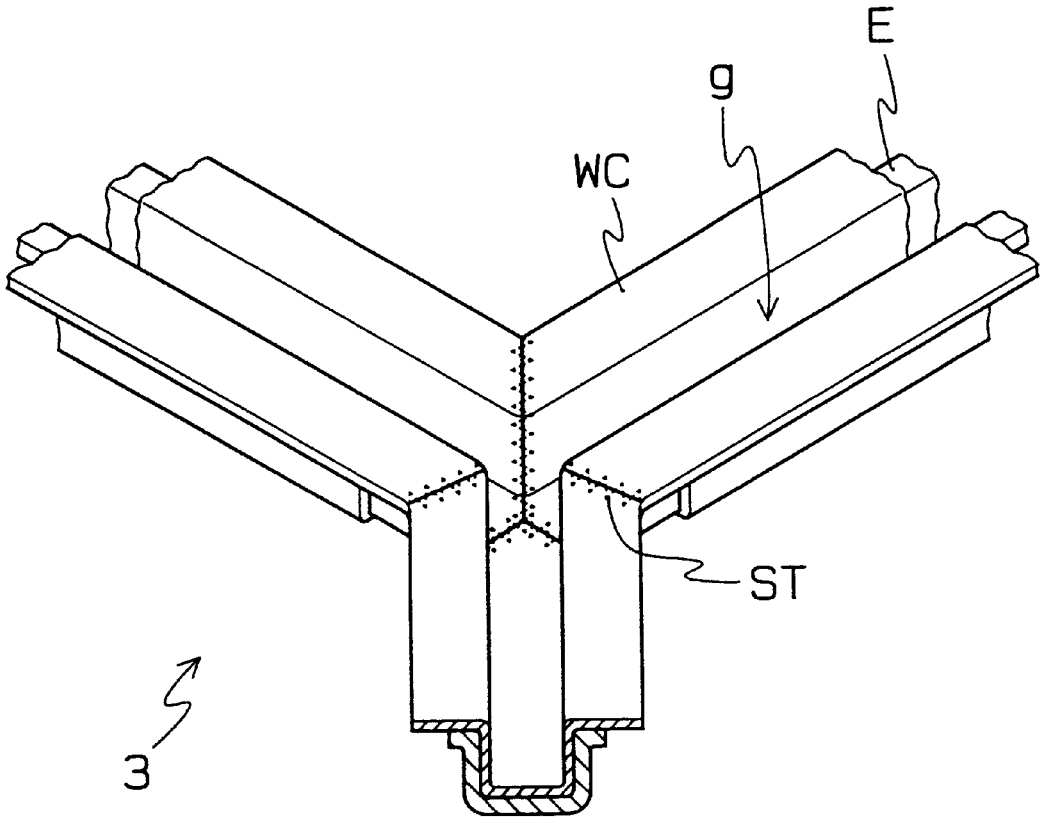
FIG. 14 is a schematic explanatory view showing another example of the ball of the present invention.

Referring to FIG. 14, the frame body 3 according to the present embodiment has a structure in which the cloths WC are superposed on an upper surface of the elastomer portion E including the groove g.

Figure 15:
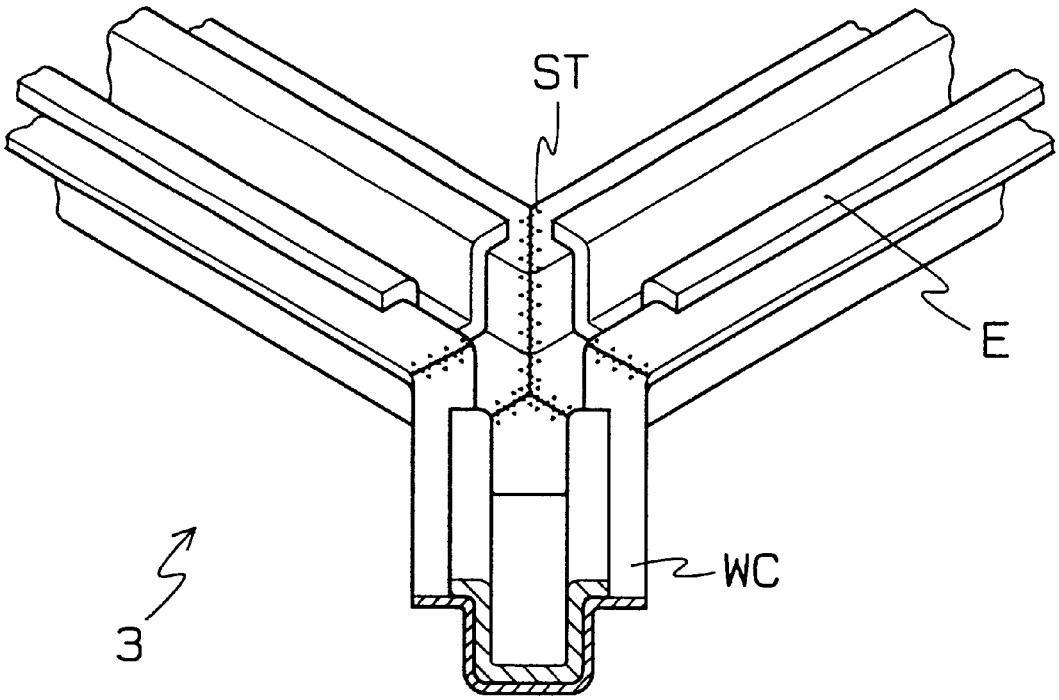
FIG. 15 is a schematic explanatory view showing another example of the ball of the present invention.

Referring to FIG. 15, the frame body 3 according to the present embodiment has a structure which is opposite from the structure shown in FIG. 14 (i.e., the elastomer portion E comes upside).

In each of the embodiment shown in FIGS. 13 to 15, the elastomer and the cloth are adhered simultaneously at the time of injection molding (insert molding). Alternatively, they may be adhered using polyurethane-based adhesive after molding. The rubber or elastomer does not exist in portions to be sewed. This is because that these portion can be sewed.

As shown in FIGS. 10 to 15, if the cloth is used on a surface of the frame constituting portion, a strength of the adhesion with the skin panel is enhanced. In this case, CR (chloroprene)-based adhesive is suitable. This is because that the rubber or elastomer is twined around the fuzz of the cloth at the time of molding, and coupled to the cloth with anchor effect.

As in each of the embodiments shown in FIGS. 13 to 15, the reason why a width of the cloth portion is widened and extended to the opposite sides of the rubber or elastomer portion is to increase the adhesion area so that the cloth is strongly adhered to the skin panel at that portion. In this case, it is preferable that the portion of the cloth which is widened is formed into a flap shape.

Figure 16:
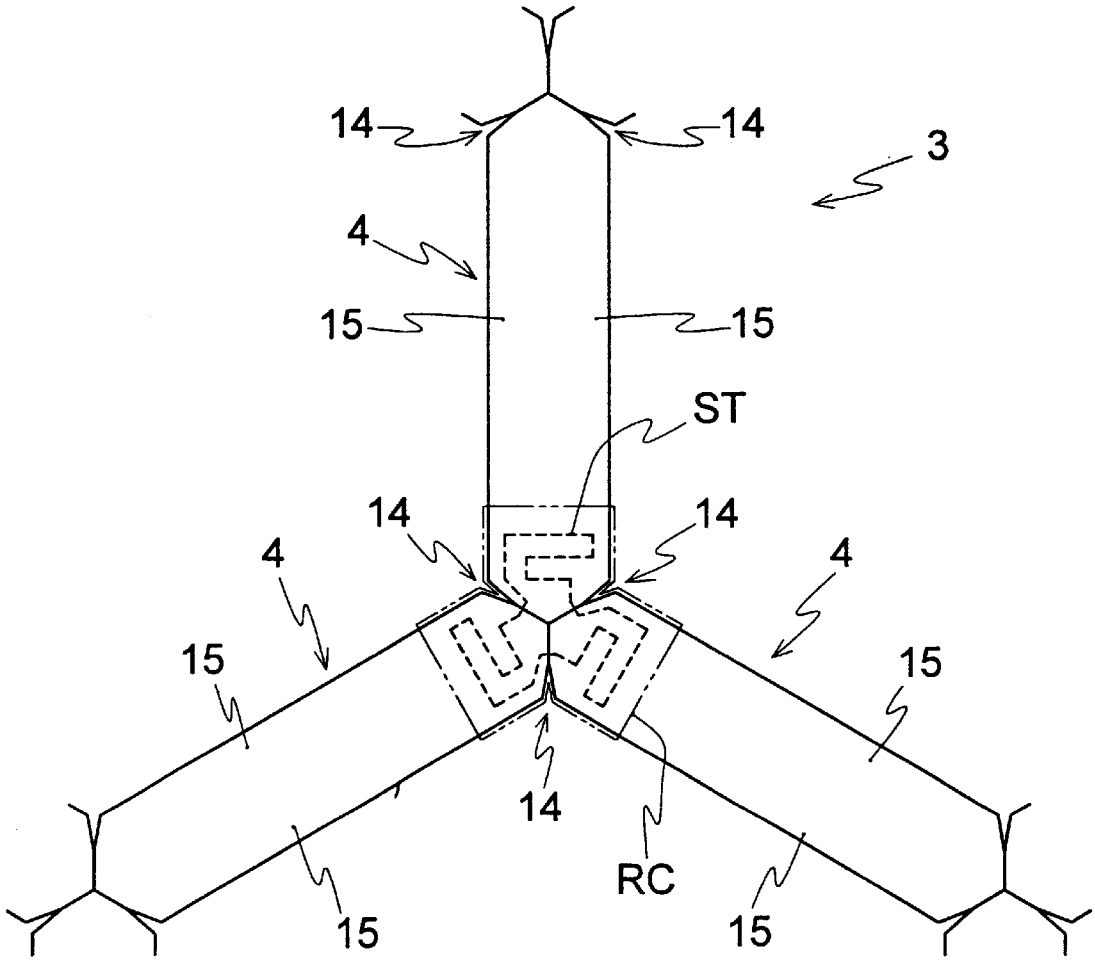
FIG. 16 is a schematic explanatory view showing another example of the ball of the present invention.
Figure 17:
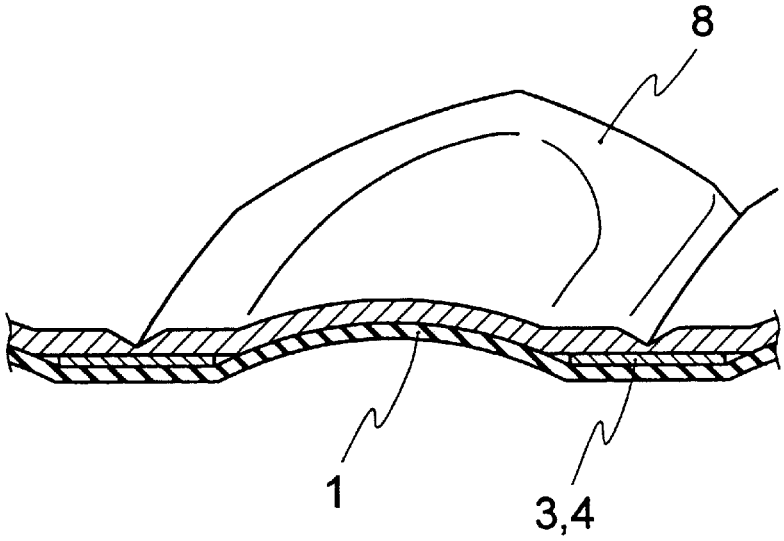
FIG. 17 is a sectional explanatory view showing another embodiment of the ball in which flap is not formed.
Figure 18:
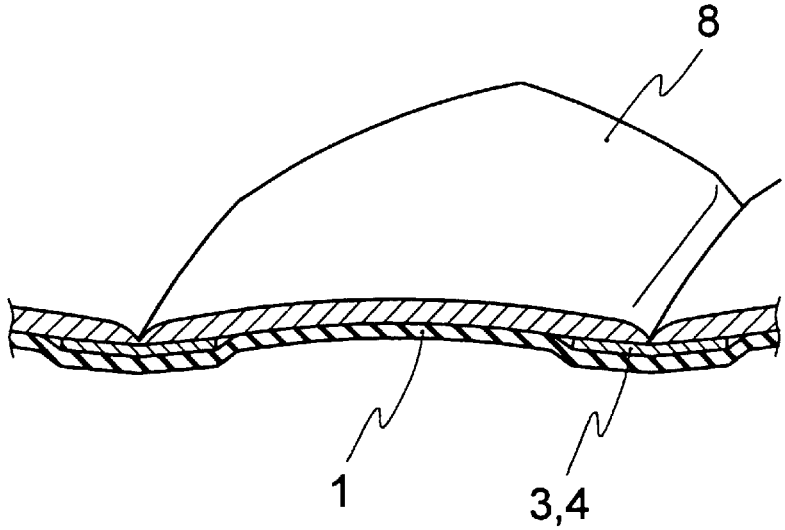
FIG. 18 is a sectional explanatory view showing another embodiment of the ball in which flap is formed.

FIG. 16 shows another embodiment of the frame body 3. Frame constituting portions 4 are partially cut (the cut portions are shown with 14), flaps 15 are formed in the frame constituting portions 4. FIGS. 17 and 18 show a case in which the flaps 15 are not formed and a case in which the flaps 15 are formed, respectively. When the flaps 15 are not formed, if a pressure is applied from the bladder 1, the frame constituting portion keeps a linear state in cross section, only the regions surrounded by the frame constituting portions 4 are expanded, and the ball as a whole is deformed into a distorted shape. Whereas, when the flaps 15 are formed, the flaps 15 of the frame constituting portions 4 are folded outward, and the cross section of each of the frame constituting portions 4 is folded into V-shape. As a result, the entire skin panels form a smooth curved line, and the entire ball forms a natural cubic. Therefore, it is preferable that the frame body 3 is formed with the flap 15. When the flap 15 is formed, since this does not exert an influence to the spherical shape, a width thereof can be wider as compared with a case without flap 15, for example, the width can be in a range of 20 to 40 mm. Therefore, the contacting area with the skin panel 8 can be wider and thus, the adhesion strength can be increased.

The cut 14 is formed at the mating portion of the frame constituting portions 4, and the same cuts 14 are formed in the backing cloth RC corresponding to the cuts 14 of the frame constituting portions 4.

Figure 19:
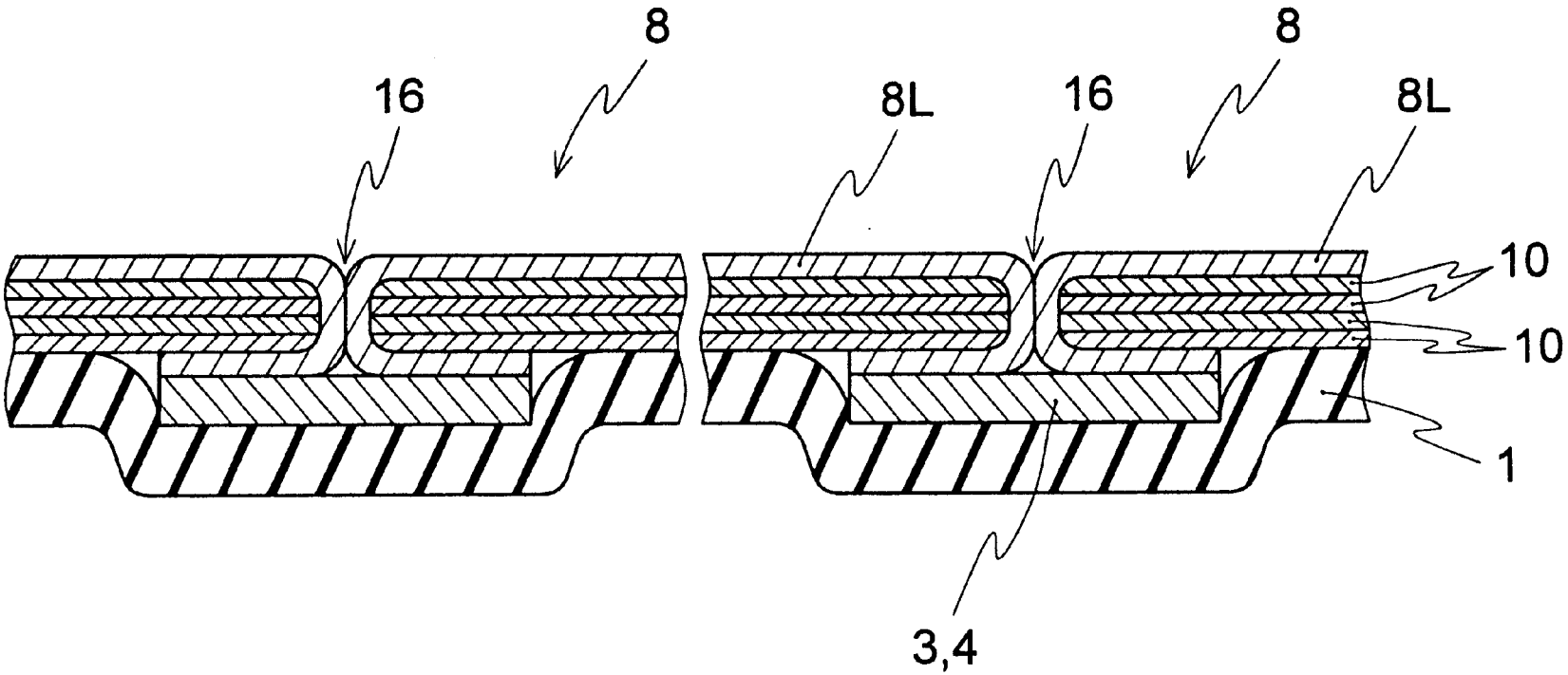
FIG. 19 is a sectional explanatory view showing another example of the skin panel used in the ball of the present invention.
Figure 20:
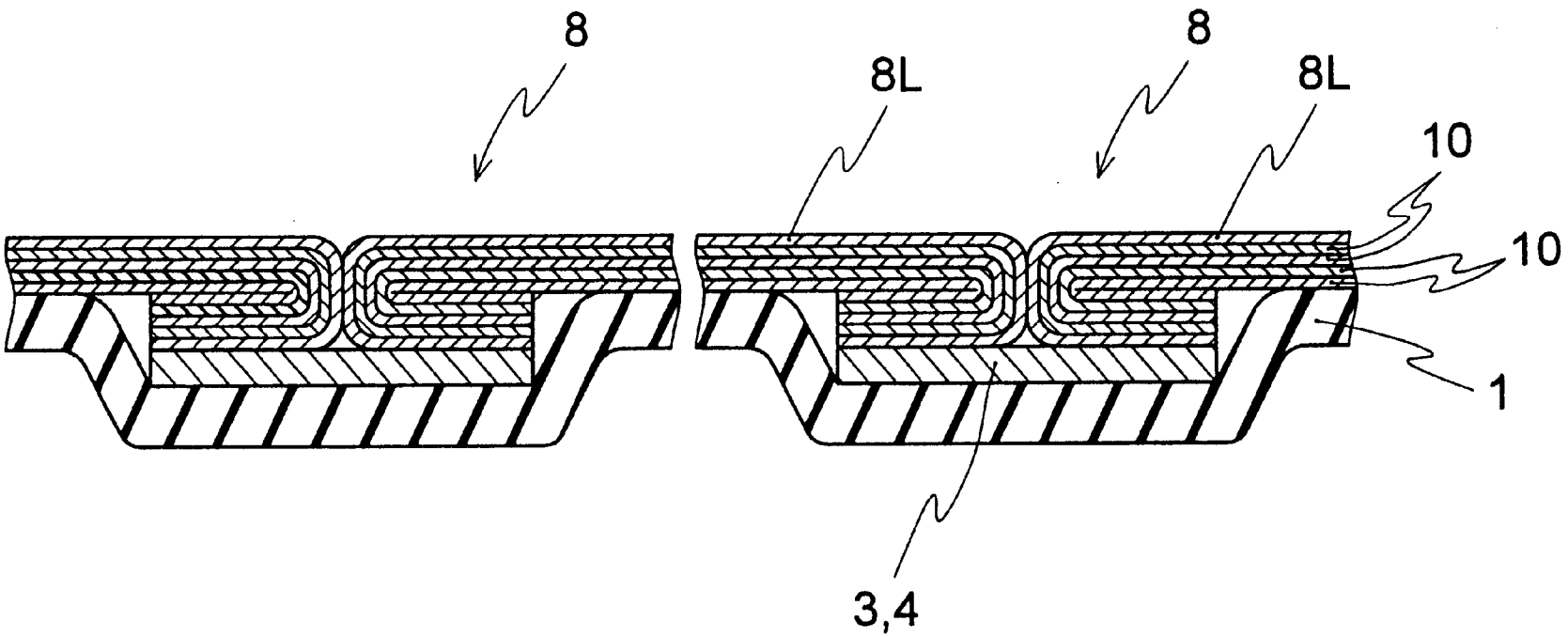
FIG. 20 is a sectional explanatory view showing another example of the skin panel used in the ball of the present invention.

FIGS. 19 and 20 show another embodiment of the skin panel 8. The skin panel 8 is structured such that the skin 8L of a surface constituting the skin panel 8 covers a portion of side surfaces of ends and back surfaces of the cloths 10, 10, . . . . FIG. 19 shows the cloths 10, 10, . . . covered with the skin 8L only, and FIG. 20 shows the skin 8L folded together with the cloths 10, 10, . . . . In these examples, the skin panel 8 is adhered to the frame constituting portion 4. At the same time, a mating portion (side surfaces) between the adjacent skin panels 8 and 8 may be adhered to each other. As the adhesive, CR (chloroprene)-based adhesive or urethane-based adhesive can be used. With the above-described structure, the joint portion between the skin panels 8 and 8 becomes the same as the hand stitched ball. That is, the joint portion between the skin panels is formed with a groove 16 having a width of 2 to 3 mm which is the same as that of the hand-stitched type ball, this groove 16 exhibits an effect to reduce the air resistance and as a result, an effect that the carry is increased can be obtained. This effect is greater than that of the ball using the diagonally cut skin panel. With the above-described structure, the skin panels 8 and 8 should not be separated from each other at their joint portion and therefore, water is prevented from entering from the joint portion, the expansion of the ball itself is suppressed, and the durability of the ball is enhanced.

Figure 21:
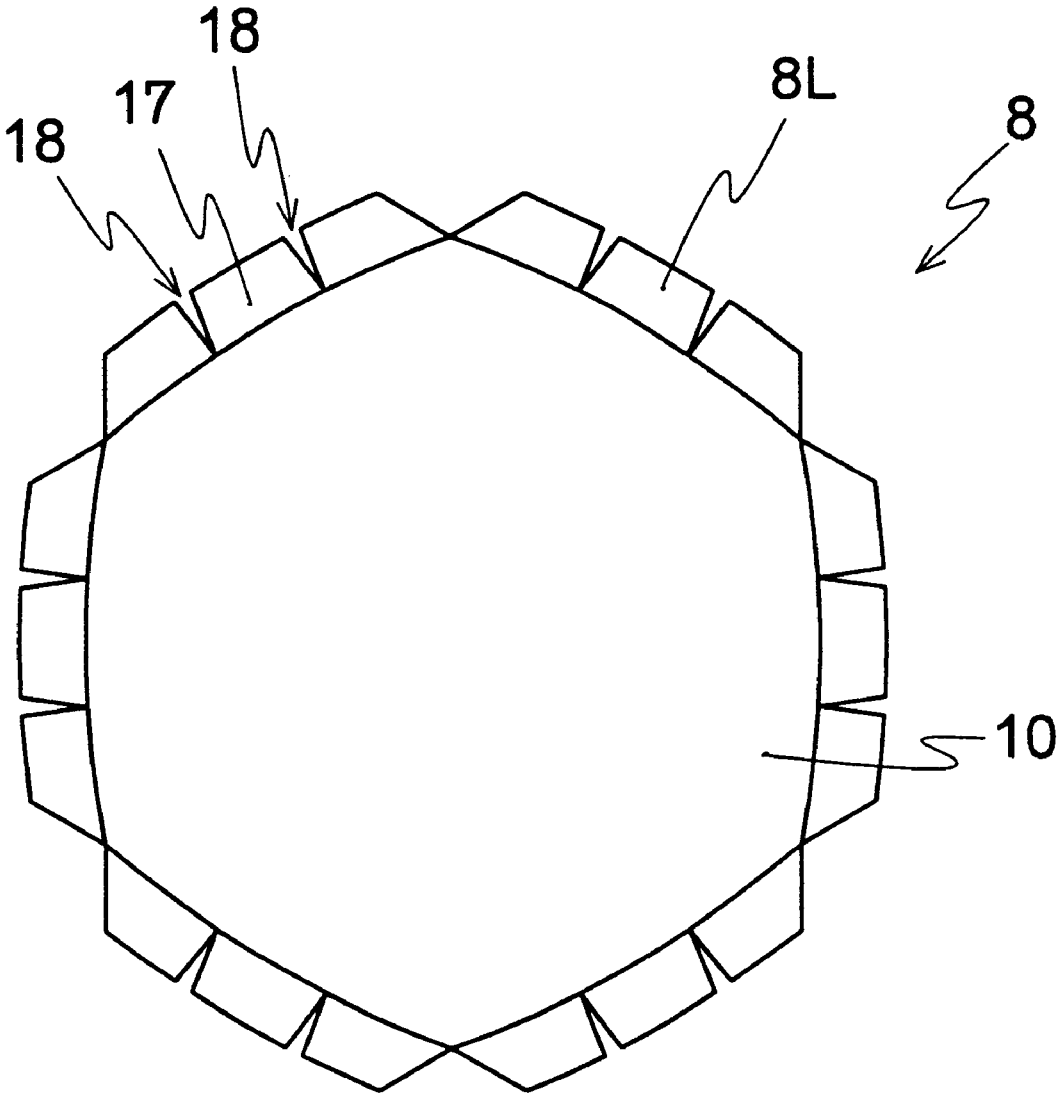
FIG. 21 is a sectional explanatory view showing another example of the skin panel used in the ball of the present invention.

When the end of the skin 8L is folded while covering a side surface of the end of the cloth 10 as shown in FIG. 19, it is necessary that such a folded portion 17 is provided at its intermediate portion with a V-shaped cut 18 as shown FIG. 21. This is because that each of sides of the polygonal skin panel 8 is slightly curved outward so as to lie along the spherical surface.

Figure 22:
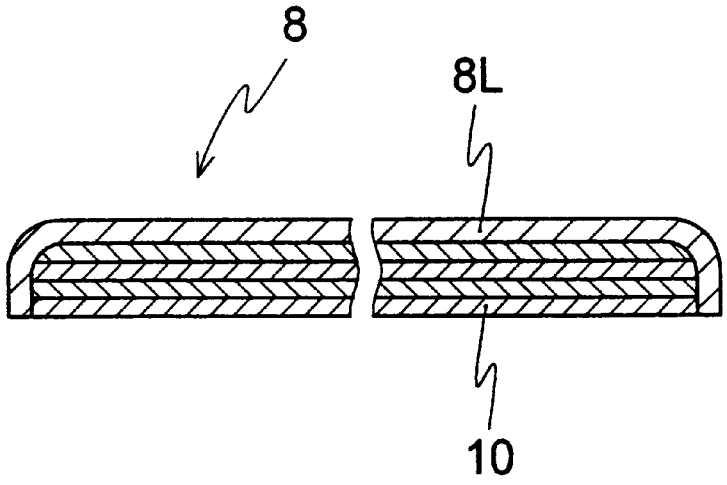
FIG. 22 is a sectional explanatory view showing another example of the skin panel used in the ball of the present invention.

FIG. 22 shows another embodiment of the skin panel 8 in which the skin 8L is extended over the cloths 10, 10, . . . only.

Figure 23:
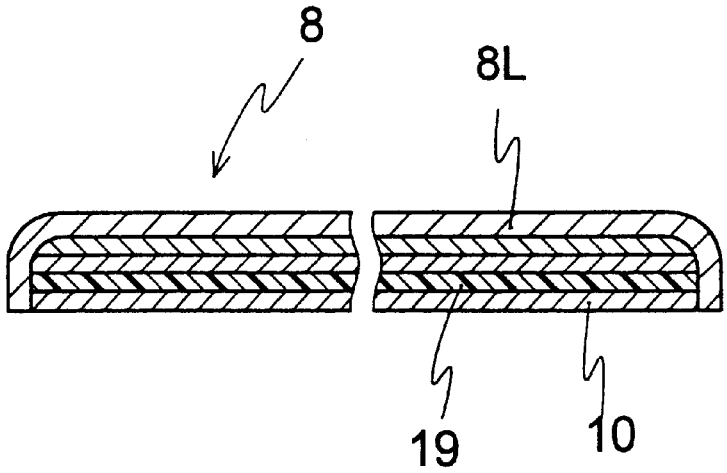
FIG. 23 is a sectional explanatory view showing another example of the skin panel used in the ball of the present invention.

FIG. 23 shows a structure in which a strength of the skin panel 8 is further enhanced. One of the cloths 10, 10, . . . is replaced by a reinforcing layer 19, e.g., a polyester film, or the reinforcing layer 19 is added. The same effect can be obtained even if this reinforcing layer 19 is adhered to the frame body 3 in addition to the skin panel 8. As a material of the reinforcing layer 19, PVC film, polyethylene film or polypropylene film can be used in addition to the polyester film.

Figure 24:
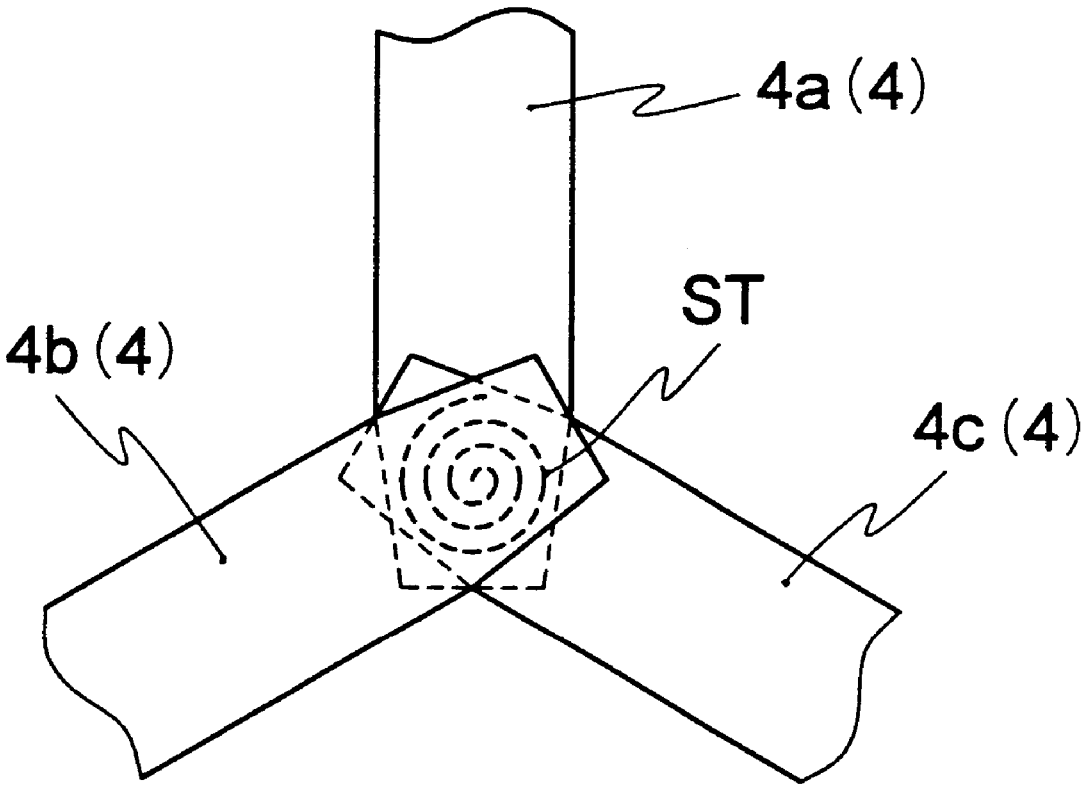
FIG. 24 is an explanatory view showing an example of a construction of sewed cloth constituting a frame constituting portion of the ball of the present invention.

FIG. 24 shows another example of the sewing structure of the cloths constituting the frame constituting portion 4. Ends of three slender rectangular portions 4 are superposed and sewed in a spiral shape. With this structure, the backing cloth RC as in the previous embodiment is unnecessary, and sewing operation can be simplified and quickened, and the strength of the sewed portion can be enhanced. More specifically, in this superposed and sewed structure, as a result of a repeated compression test (30% compression, 5,000 times repetitions), the rate of expansion (the rate of expansion of the circumference) was 0.89%. In the firstly shown case in which the cloths are mated with each other and sewed together, the rate of expansion was 3.01%.

Figure 25:
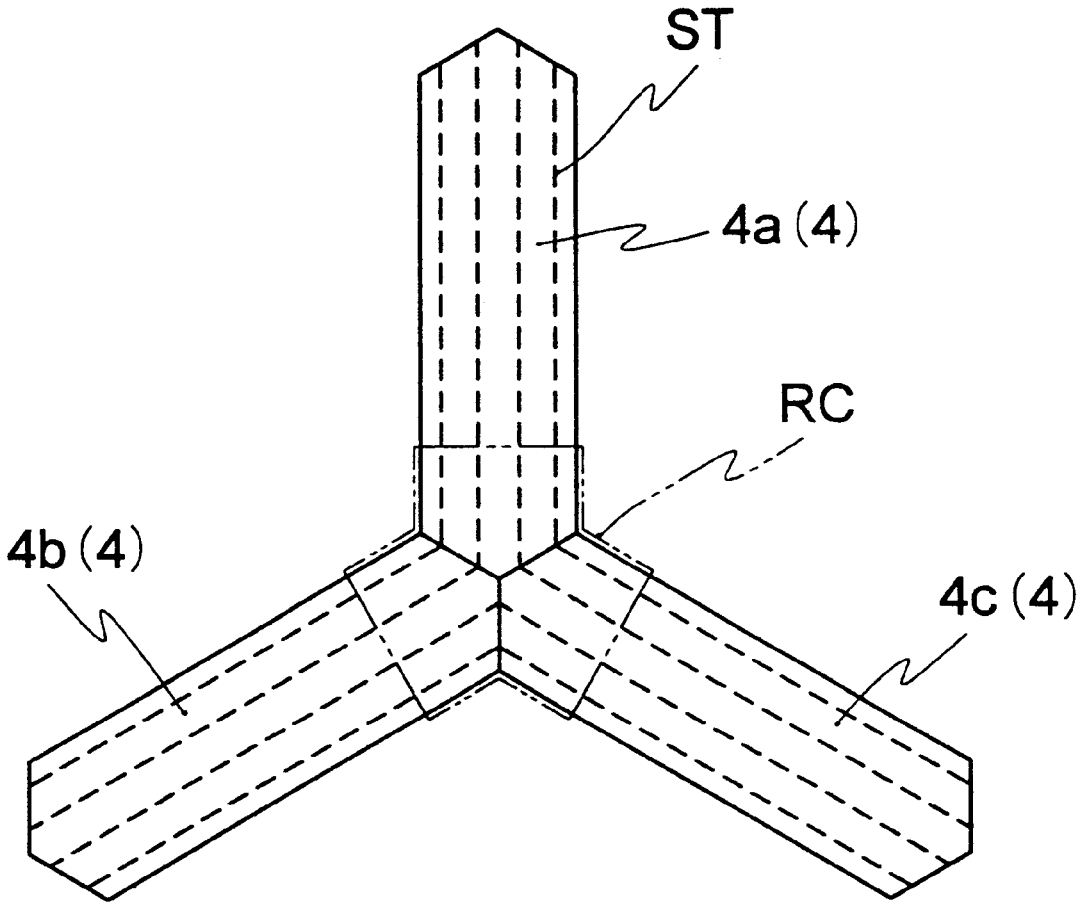
FIG. 25 is an explanatory view showing an example of a construction of sewed cloth constituting a frame constituting portion of the ball of the present invention.

FIG. 25 shows another embodiment of the sewing structure of the cloths constituting the frame constituting portions 4. As the previous embodiment, each of the ends of the three slender rectangular frame constituting portions 4 is formed into sharp shape having 120 degrees, and these three ends are mated together, a backing cloth RC is attached to a back side of the mated ends, and they are sewed with a thread ST. Sewing direction with the thread ST is longitudinal direction of the frame constituting portion 4. With this structure, the sewing time can be shortened about one-half of the firstly shown example.

The skin panel 8 and the frame body 3 may be structured separately from the bladder 1 without adhering to the bladder 1 unlike the above-described embodiments. In this case, since the frame body 3 receives the pressing force from the bladder 1 and is fixed to the bladder 1, the frame body 3 should not move with respect to the bladder 1. Further, the skin panel 8 may be adhered to the bladder 1 not only at a portion of the skin panel 8 corresponding to the frame body 3 but also at entire back surface of the panel 8 by CR-based adhesive. With such a structure, the durability of the ball is enhanced, and as a result of experiment, the rate of expansion when the entire back surface is adhered was 1.5% whereas the rate of expansion when the entire back surface is not adhered was 2.0%. In the latter case, adhesive is applied to every frame body 3 accommodating the bladder 1 by dipping the frame body 3 into adhesive tank, and this operation is simpler than applying the adhesive only to the above-described frame body 3.

Figure 26:
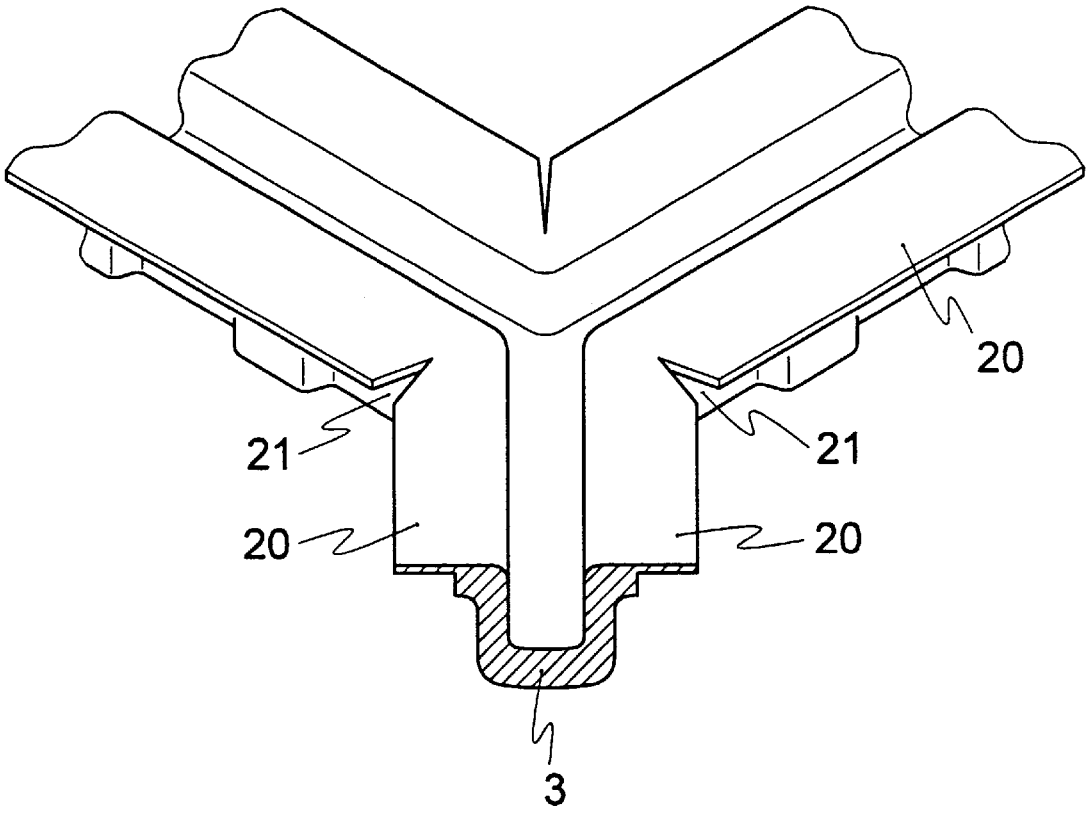
FIG. 26 is an explanatory view showing the ball of the present invention in which a reinforcing element is added to the construction shown in FIG. 7 or FIG. 8.

FIG. 26 shows the structure shown in FIGS. 7 and 8 to which groove portions provided at their opposite end edges with adhesion reinforcing portions 20 extending in circumferential direction of the ball are added. The adhesion reinforcing portions 20 at location where the grooves are crossing are formed with cuts 21, and the adhesion reinforcing portions 20 form flaps. By the flap-like adhesion reinforcing portions 20, the adhesion between the frame body 3 and the skin panel is strengthened and at the same time, a smooth spherical surface as a ball can be obtained.

According to the ball of the present invention, since the ball has maintenance property and flexibility, and uses the spherical frame body forming a plurality of spaces, the conventional winding reinforcing layer is not necessary, and a soft touch feeling and a high control property of the ball which are features of the hand stitched ball can be obtained. Further, drawbacks of the hand stitched ball, i.e., variation in size, separation from seam are not generated, and it is possible to produce durable and high-quality balls with high productivity.

According to the ball of the present invention, since the frame constituting portion of the frame body is formed slender with respect to a line along which the skin panels are contacted, it is positioned only on a portion which requires the frame body. Therefore, the amount of frame body with respect to the entire ball can be minimized for maintaining the shape, and a soft touch feeling can be obtained. Further, the frame body constituting portion is connected such that a closure domain is constituted, a pressure of the bladder is dispersed, the bladder is supported uniformly, and the spherical shape is efficiently maintained.

According to the ball of the present invention, the frame body constituting portion of the frame body is of a flat plate shape and therefore, the skin panels can be adhered by the same manufacturing process as that of the laminated ball. Further, by using the skin panels which are diagonally cut, it is possible to realize a ball having the same outer appearance as the laminated ball.

According to the ball of the present invention, since a cross section of the flap is deformed into V-shape in accordance with a variation in internal pressure of the flap when internal pressure of the bladder or a shock is applied to the flap, the degree of deformation of the skin panel is large and thus, the degree of deformation of the ball itself is large. That is, since the ball is freely deformed without being forced, operating property and control property are enhanced.

According to the ball of the present invention, since the frame body comprises thermoplastic elastomer, the frame body can automatically and swiftly molded by injection molding or the like.

According to the ball of the present invention, since the frame body comprises a cloth, when it is adhered to the skin panel, the adhesive can be penetrated into fiber of the cloth and therefore, the adhesion strength can be enhanced.

According to the ball of the present invention, rubber elastic material is used as the frame body. With this rubber elastic material, elasticity softer than thermoplastic elastomer can be obtained, and adhesion strength with respect to the skin panel is enhanced.

According to the ball of the present invention, a surface of the frame body can be formed flatly and thus, outer appearance of the surface of the skin panel is enhanced.

According to the ball of the present invention, since connected portions of the frame constituting portions are superposed and sewed together, the connected portions can be strengthened.

According to the ball of the present invention, it is possible to realize a ball having the same outer appearance as that of the covered ball, and having the same touch feeling as the manually woven ball.

According to the ball of the present invention, the groove is formed in the connected portion of the skin panels, and it is possible to realize a ball having the same outer appearance as that of the hand stitched ball, and air resistance can be lowered by this groove and thus, carry can be increased.

According to the ball of the present invention, tensile strength of the skin panel can be enhanced, which makes it possible to suppress the expansion of the ball, to enhance the durability, and to elongate the lifetime.

According to the ball of the present invention, it is possible to realize a ball having the same outer appearance as that of the hand stitched ball, and to enhance the carry as described above.

According to the ball of the present invention, it is possible to improve the adhesion strength of the skin panels by adding the adhesion reinforcing portion, and to enhance the durability of the ball. Further, since the adhesion reinforcing portion has the flap structure, it is possible to suppress, to the minimum, an influence exerted on the cubic shape of the ball and deformation effect when external force is applied.

According to the ball of the present invention, it is possible to enhance the strength of the frame body by the thick reinforcing portion, and to strengthen the connection between the skin panel and the frame body.

According to the ball of the present invention, when the ball is used as a soccer ball or handball, the ball can be suitable for playing soccer game or handball game in terms of operation property, ball-control property, touch feeling, durability and the like.

According to the ball of the present invention, when the ball is used as a volleyball or playground ball, the ball can be suitable for playing volley ball game or playground ball game in terms of operation property, ball-control property, touch feeling, durability and the like.

Industrial Applicability

The ball for ball game of the present invention is useful for ball employed in the official games such as Olympic Games where highly able players compete with each other because of high ball-control property.

What is claimed is:

1. A ball for a ball game comprising:

a bladder of an air-impermeable elastic material and having a hollow spherical shape;

a flexible, generally spherical skeletal frame separate from and surrounding the bladder, maintaining bladder shape, and including a plurality of openings; and a plurality of skin panels constituting a surface of the ball, each skin panel including at least one edge and having a shape geometrically similar to at least one opening of the frame, the edges of the skin panels being adhered to the frame with an edge of each skin panel in contact with an edge of another skin panel on the frame.

2. The ball of claim 1, wherein the generally spherical skeletal frame comprises a plurality of body portions interconnected in a network and lying along lines on which edges of the plurality of skin panels contact one another, the frame portions are connected to enclose a volume, and the edges of the skin panels are adhered to the frame portions.

3. The ball of claim 2, wherein the frame portions have, in cross-section, a plate shape.

4. The ball of claim 3, wherein the frame portions are partially recessed for receiving edges of the skin panels as flaps for maintaining a natural shape of the ball.

5. The ball of claim 2, wherein the frame portions include, in cross-section, respective grooves recessed toward a center of the ball, and edges of the skin panels are folded into the grooves.

6. The ball of claim 5, wherein the grooves, at opposite edges, include an adhesion reinforcing portion extending in a circumferential direction of the ball and to which the edges of the skin panels are adhered.

7. The ball of claim 5, wherein the frame portions comprise a thermoplastic elastomer.

8. The ball of claim 5, wherein the frame portions comprise a cloth portion and a thermoplastic elastomer portion.

9. The ball of claim 7, including thickened reinforcing portions on side surfaces of the grooves.

10. The ball of claim 1, wherein the frame portions comprise a thermoplastic elastomer.

11. The ball of claim 1, wherein the frame portions comprise a cloth having at least a single layer.

12. The ball of claim 11, wherein the frame portions have edges of the cloth arranged side-by-side and include a backing cloth backing the side-by-side edges, and the edges are sewn together.

13. The ball of claim 11, wherein the frame portions have edges of the cloth superposed and sewn together.

14. The ball of claim 11, wherein each skin panel comprises a plurality of cloths pasted to a back surface of a skin, and edges of the cloth are covered by the skin.

15. The ball of claim 14, including a reinforcing layer interposed between the plurality of cloths.

16. The ball of claim 15, wherein the reinforcing layer is made of at least one of polyester, PVC, polyethylene, and polypropylene.

17. The ball of claim 1, wherein the frame portions comprises at least one cloth and a laminated rubber elastic material.

18. The ball of claim 1, wherein each skin panel comprises a plurality of cloths pasted to a back surface of a skin, and an edge of the back surface of the skin is diagonally cut.

19. The ball of claim 1, wherein the frame includes thirty-two openings the openings comprising twelve equilateral pentagons and twenty equilateral hexagons, the frame being curved outwardly into a spherical shape, and the skin panels have pentagonal and hexagonal shapes substantially corresponding to the openings in the frame.

20. The ball of claim 1, wherein the frame includes a plurality of substantially rectangular openings, and the skin panels are a plurality of substantially rectangular panels adhered to the frame.

21. A ball for a ball game comprising:

a bladder of an air-impermeable elastic material and having a hollow spherical shape;

a flexible, generally spherical skeletal frame separate from and surrounding the bladder, maintaining bladder shape, and including a plurality of openings, wherein the frame has a modulus at 50% in a range of 30 to 200 $Kg/cm^2$ and a D-hardness in a range of 30 to 75 degrees; and a plurality of skin panels constituting a surface of the ball, each skin panel including at least one edge and having a shape geometrically similar to at least one opening of the frame, the edges of the skin panels being adhered to the frame with an edge of each skin panel in contact with an edge of another skin panel on the frame.

* * * * *